US007748195B2

(12) United States Patent
Keith

(10) Patent No.: US 7,748,195 B2
(45) Date of Patent: Jul. 6, 2010

(54) BRACKET AND METHOD FOR SUPPORTING A PLATFORM FROM CONCRETE FORM TABS

(76) Inventor: Jerry Lee Keith, 56755 White Oak, Senecaville, OH (US) 43780

( * ) Notice: Subject to any disclaimer, the term of this patent is extended or adjusted under 35 U.S.C. 154(b) by 0 days.

(21) Appl. No.: 12/110,645

(22) Filed: Apr. 28, 2008

(65) Prior Publication Data

US 2008/0202064 A1 Aug. 28, 2008

Related U.S. Application Data

(62) Division of application No. 11/183,550, filed on Jul. 18, 2005.

(60) Provisional application No. 60/646,192, filed on Jan. 19, 2005, provisional application No. 60/588,411, filed on Jul. 16, 2004.

(51) Int. Cl.
*E04G 3/20* (2006.01)
*E04G 5/04* (2006.01)

(52) U.S. Cl. ..... 52/745.21; 52/699; 52/73; 248/235; 182/87; 249/219.1

(58) Field of Classification Search ..... 52/127.2, 52/127.9, 745.14, 745.21, 73, 699, 700; 182/82, 150, 87, 186.9; 248/235, 241, 247, 248/295.11, 239; 249/219.1
See application file for complete search history.

(56) References Cited

U.S. PATENT DOCUMENTS 1,450,286 A * 4/1923 Graff ..... 248/240.3
1,608,036 A * 11/1926 Robinson ..... 248/240.3
2,066,984 A 1/1937 Lamb
2,136,696 A * 11/1938 Lamb ..... 182/113
2,279,850 A * 4/1942 Vansickle ..... 248/235
2,577,979 A * 12/1951 Pierson et al. ..... 248/235
2,882,101 A * 4/1959 Michalak et al. ..... 248/235
2,916,245 A * 12/1959 Williams ..... 248/242
3,070,337 A * 12/1962 Gates ..... 182/87
3,374,984 A * 3/1968 Mueller ..... 249/216
3,420,491 A * 1/1969 Gilbert et al. ..... 249/216
3,472,477 A * 10/1969 Juhl ..... 249/219.1
3,490,730 A * 1/1970 Gates, Jr. ..... 249/43

(Continued)

FOREIGN PATENT DOCUMENTS

DE 33 47 395 7/1985

(Continued)

OTHER PUBLICATIONS

Amendment submitted to U.S. Patent Office on Mar. 17, 2008, in response to Office Action mailed Oct. 17, 2007, for U.S. Appl. No. 11/183,550.

(Continued)

*Primary Examiner*—Robert J Canfield
*Assistant Examiner*—Brent W Herring
(74) *Attorney, Agent, or Firm*—Calfee, Halter & Griswold LLP

(57) ABSTRACT

A support or jack that hangs from the tabs of a poured concrete wall. The support may include a hook that engages in an opening in the tab, to connect the support to the wall. The support may include a slot in which the tab is received, to connect the support to the wall.

16 Claims, 4 Drawing Sheets

U.S. PATENT DOCUMENTS

| | | | | | |
|---|---|---|---|---|---|
| 3,661,354 | A | * | 5/1972 | Dagiel et al. | 249/192 |
| 3,690,613 | A | * | 9/1972 | Shoemaker | 249/40 |
| 3,785,610 | A | * | 1/1974 | Dagiel | 249/214 |
| 3,804,199 | A | * | 4/1974 | Bondi | 182/82 |
| 3,874,625 | A | * | 4/1975 | Hansen et al. | 248/354.5 |
| 4,079,556 | A | * | 3/1978 | Luck et al. | 52/127.2 |
| 4,158,452 | A | | 6/1979 | Gates | |
| 4,210,306 | A | * | 7/1980 | Schimmel | 249/196 |
| 4,304,388 | A | * | 12/1981 | Gates | 249/219.2 |
| 4,452,336 | A | * | 6/1984 | Sickler | 182/82 |
| 5,110,083 | A | * | 5/1992 | Page | 249/46 |
| 5,209,039 | A | * | 5/1993 | Boeshart | 52/699 |
| 5,259,477 | A | * | 11/1993 | Fears et al. | 182/82 |
| 5,524,727 | A | * | 6/1996 | Yennie, Jr. | 182/82 |
| 5,651,910 | A | * | 7/1997 | Myers et al. | 249/41 |
| 6,237,890 | B1 | * | 5/2001 | Gates | 249/219.2 |
| 7,070,158 | B1 | * | 7/2006 | Gamble | 249/20 |
| 2006/0243524 | A1 | * | 11/2006 | Jarrell | 182/82 |

FOREIGN PATENT DOCUMENTS

| | | | |
|---|---|---|---|
| DE | 4340199 | C1 * | 4/1995 |
| JP | 2004027658 | A * | 1/2004 |

OTHER PUBLICATIONS

Final Office Action mailed Aug. 8, 2008, for U.S. Appl. No. 11/183,550.

Non-Final Office Action dated Mar. 5, 2009, for related U.S. Appl. No. 11/183,550.

Response dated Jun. 5, 2009, to Non-Final Office Action dated Mar. 5, 2009, for related U.S. Appl. No. 11/183,550.

* cited by examiner

BRACKET AND METHOD FOR SUPPORTING A PLATFORM FROM CONCRETE FORM TABS

Related Applications

This application is a divisional of, claims priority to, and any other benefit of, U.S. patent application Ser. No. 11/183,550, filed on Jul. 18, 2005, and entitled BRACKET AND METHOD FOR SUPPORTING A PLATFORM FROM CONCRETE FORM TABS, and claims priority to, and any other benefit of, U.S. Provisional Application No. 60/646,192, filed Jan. 24, 2005, and U.S. Provisional Application No. 60/588,411, filed Jul. 17, 2004; the entire disclosures of all which are hereby incorporated by reference.

BACKGROUND OF THE INVENTION

Some buildings are constructed with a poured concrete wall, such as for a basement. The wall may be constructed using spaced forms creating a cavity into which the concrete is poured. When the concrete is sufficiently cured, the forms are removed.

The forms are typically panels supported in a predetermined configuration with a gap between them forming the cavity. The panels on opposite sides of the gap are held apart from each other by wall brackets (also known as "wall ties"), some at the top of the gap which are exposed, and other intermediate brackets that extend through the gap. The wall brackets have end portions to which the panels are connected. Typically the wall brackets have openings at each end through which a pin extends to secure adjacent forms to each other and to the bracket. After the concrete is poured and set, the panels and the exposed end brackets are removed, leaving the intermediate brackets with their end portions extending from the surface of the wall. These projecting end portions form tabs that are removed, e.g., they can be bent back and forth by hammer blows until they are broken off, thus leaving a relatively smooth wall.

It may thereafter be necessary to work along the vertical surface of the poured concrete wall, above ground level. To accomplish this, workers typically set up ladders with ladder jacks, with a work platform, such as a walkway, extending between the ladder jacks. Because of weather and safety issues, however, there are instances in which such a setup is not desirable.

SUMMARY OF THE INVENTION

In one aspect the present invention relates to a support that hangs from the tabs of a wall brackets in a poured concrete wall. The support may include a hook that engages in an opening in the tab, to fasten the support to the wall. The support may include a slot in which the tab is received, with a pin extending through, to fasten the support to the wall. As but two examples, the support may be made from angle iron or from tubular metal. The support may extend for the full height of the wall that is below the support, or may have a relatively short vertical extent.

In another aspect the present invention relates to a method of supporting a work platform by hanging one or more supports from tabs of wall brackets of a poured concrete wall.

BRIEF DESCRIPTION OF THE DRAWINGS

Further features of the invention will be apparent to one of ordinary skill in the art to which the invention pertains, from a reading of the following description in conjunction with the attached drawings, in which.

DETAILED DESCRIPTION OF EMBODIMENTS OF THE INVENTION

Figure 1:
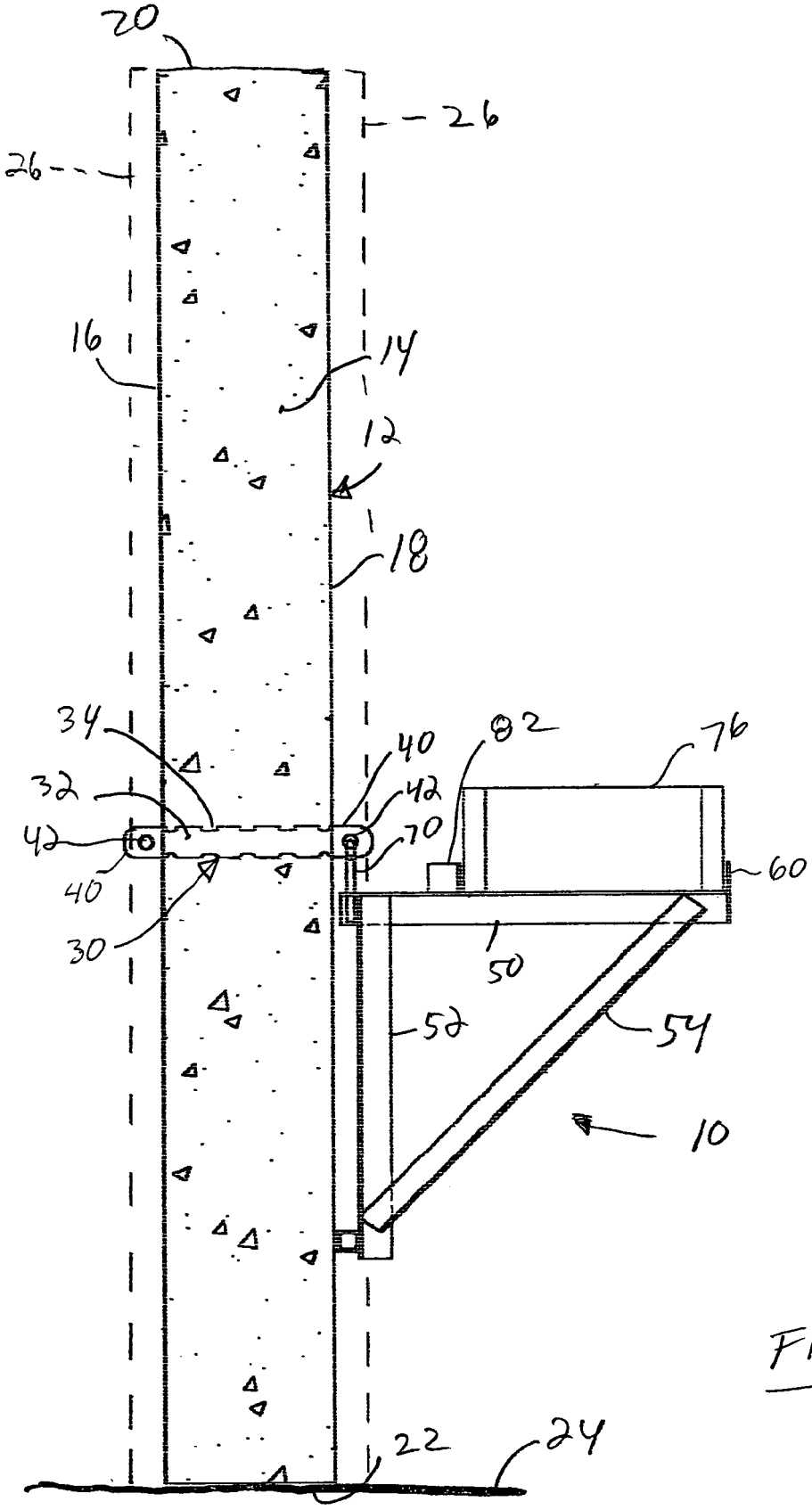
FIG. 1 is a side elevation of a support bracket that is a first embodiment of the invention, shown in association with a poured wall.
Figure 4:
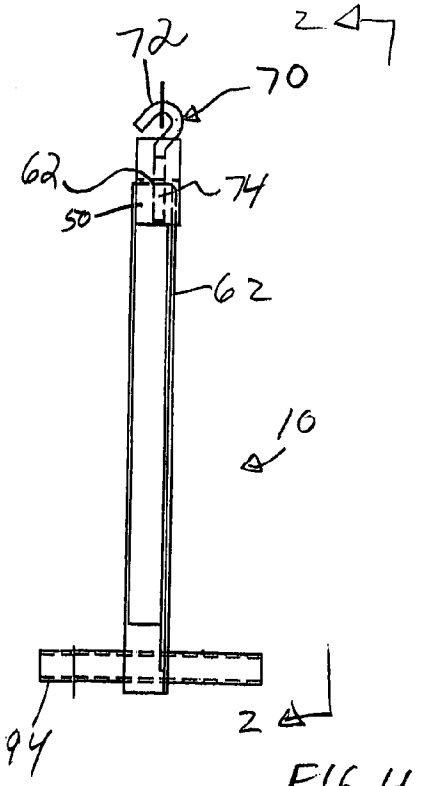
FIG. 4 is an end elevational view of the support bracket of FIG. 1.
Figure 3:
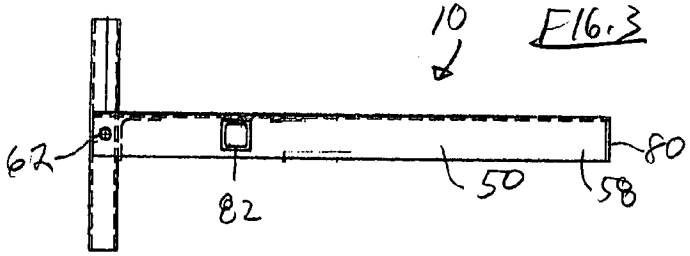
FIG. 3 is a top plan view of the support bracket of FIG. 1.
Figure 2:
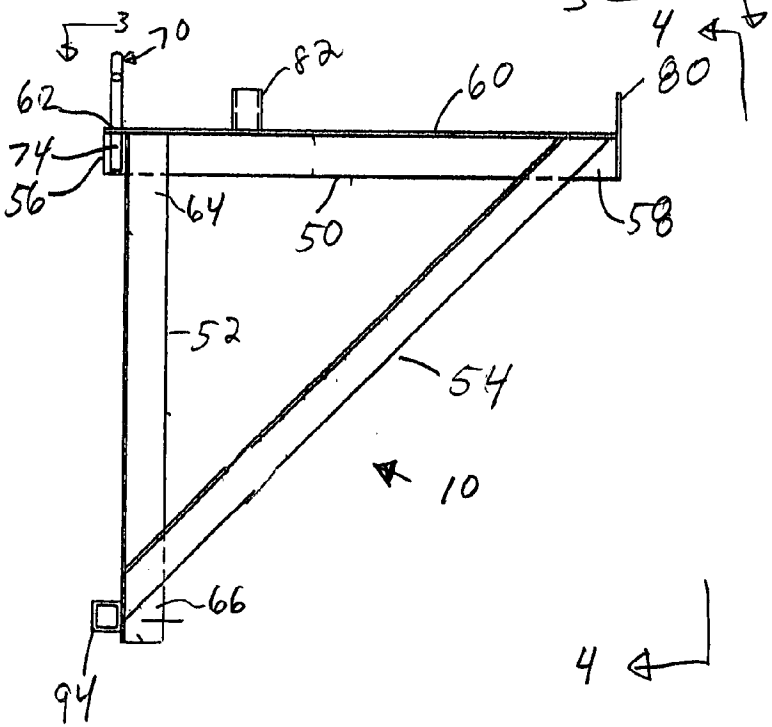
FIG. 2 is an enlarged side elevational view of the support bracket of FIG. 1.

The present invention may be embodied in various structures and methods. As on example, FIGS. 1-4 illustrate a support bracket 10 (or jack 10) that is a first exemplary embodiment of the invention. The invention is illustrated with reference to an exemplary wall 12. The wall 12 is illustrated in section and made of poured concrete material 14. The wall 12 has first and second opposite major side surfaces 16 and 18 that extend generally vertically between a top surface 20 and a bottom surface 22. The bottom surface 22 may rest on a footer 24. It should be understood that the invention is applicable to walls and poured concrete structures of other types and configurations.

The wall 12 is formed by pouring concrete material 14 between two form panels (shown in phantom at 26). The form panels, or forms, 26 are held in spaced apart relation by a plurality of wall brackets typically every four feet along the length and height of the wall. Some of the wall brackets are at the top of the wall 12 and are removed, with the forms 26, after the concrete material 14 is sufficiently cured. Others, such as the intermediate bracket shown at 30, are embedded in the concrete material 14 when it is poured and thus remain permanently in the wall.

The wall bracket 30 has a central portion 32 that is embedded in the concrete 14. The central portion 32 has grooves 34 for holding reinforcing bars (rebar). The wall bracket 30 has end portions in the form of tabs 40 that project from opposite ends of the central portion 32 of the wall bracket and that project from the wall surface 18 after the wall 12 is poured. Each tab 40 has a hole or opening 42 extending laterally through the tab. Pins (not shown) are typically inserted into the openings 42 at each end to secure adjacent forms 26 to each other and to the bracket.

The support bracket 10 shown in the first embodiment is made from a plurality of metal pieces welded together. A support bracket 10 of the present invention could be made from another material, or could be made from several pieces joined together in another manner, or could be made from one piece, for example, a single glass fiber or composite molding.

The particular exemplary support bracket 10 that is illustrated includes a horizontal piece 50, a vertical piece 52, and a brace 54, each of which is made from angle iron having an L-shaped cross-sectional configuration. The horizontal piece 50 has an inner end portion 56 and an opposite outer end portion 58. The horizontal piece 50 has a flat upper side surface 60 that is adapted for supporting a portion (e.g., an end) of a work element, such as a platform or walkway. A vertically extending opening 62 is formed in the inner end portion 56.

The vertical piece 52 has an upper end portion 64 that is welded to the inner end portion 56 of the horizontal piece 50 so that the vertical piece extends at a ninety degree angle to the horizontal piece. The vertical piece 52 has an opposite lower end portion 66. The brace 54 is welded between the lower end portion 66 of the vertical piece 52 and the outer end portion 58 of the horizontal piece 50, to help provide the bracket 10 with a rigid triangular configuration.

The exemplary support bracket 10 that is the first embodiment of the present invention includes a hook. The hook may be a hook bolt 70 having an upper hook portion 72 and a lower threaded portion 74. In one embodiment, as illustrated, the hook 70 is secured on the bracket 10 by inserting its shank through the opening 62 in the horizontal piece 50, screwing one or two nuts onto the threaded portion 74 to engage the horizontal piece 50, and thereafter welding. As a result, the hook 70 is secured in a force transmitting relationship with the horizontal piece 50, and the hook also is prevented from twisting about a vertical axis.

After the wall 12 is poured and the forms 26 are removed from the wall, the tab 40 of the wall bracket 30 projects from the wall surface 18. In accordance with the invention, the tab 40 is not broken off or removed. Instead, the support bracket 10 is placed into position adjacent the tab 40. The hook 70 is placed through the opening 42 in the tab 40 to fasten the support bracket to the wall bracket. The support bracket 10 assumes a resting position against the side surface 18 of the wall 12. The hook 70 holds the support bracket 10 on the wall 12, with the upper side surface 60 of the horizontal piece 50 of the bracket extending generally horizontally. The horizontal piece 50 and thus the support bracket 10 as a whole are thus suspended or hung from the tab 40.

A second support bracket 10 (not shown) may be positioned on the next wall bracket tab, which is typically four feet farther along the wall 12. A work structure, such as a walkway or platform, for example as shown schematically at 76, may then be placed atop the horizontal surfaces 60 of the two support brackets 10. In this way, the work structure is firmly supported on the wall 12, without the need for ladders, etc. As another example, support brackets 10 may be hung or suspended from several tabs 40 and used to support a platform that extends substantially along the entire length of a wall (inside or outside) or substantially along the entire length of multiple adjacent walls (inside or outside), e.g., substantially along the entire periphery of a structure (inside or outside).

The support bracket 10 has an optional outer walkway stop 80 at the outer end of the horizontal piece 50. The stop 80 can help to prevent a work structure, such as a walkway or other platform, from sliding off the outer end of the horizontal piece 50. The stop 80 may be, as one example, a piece of metal that is welded on the end portion 58 of the horizontal piece 50. An outer walkway stop is optional with other embodiments of the invention.

The exemplary support bracket 10 also has an optional inner walkway stop 82 near the inner end of the horizontal piece 50. The walkway stop 82 may be, as one example, a piece of angle iron or tube that is welded on the horizontal piece 50. The walkway stop 82 can help to prevent a walkway or other structure that is supported on the support bracket 10, from sliding inward toward the wall 12. A inner walkway stop 82 is optional with this and other embodiments of the invention.

Other alternative configurations are possible. For example, the horizontal piece 50 of the support bracket 10 could itself be formed into a hook or other structure for extending through the opening 42 in the tab 40.

Figure 6:
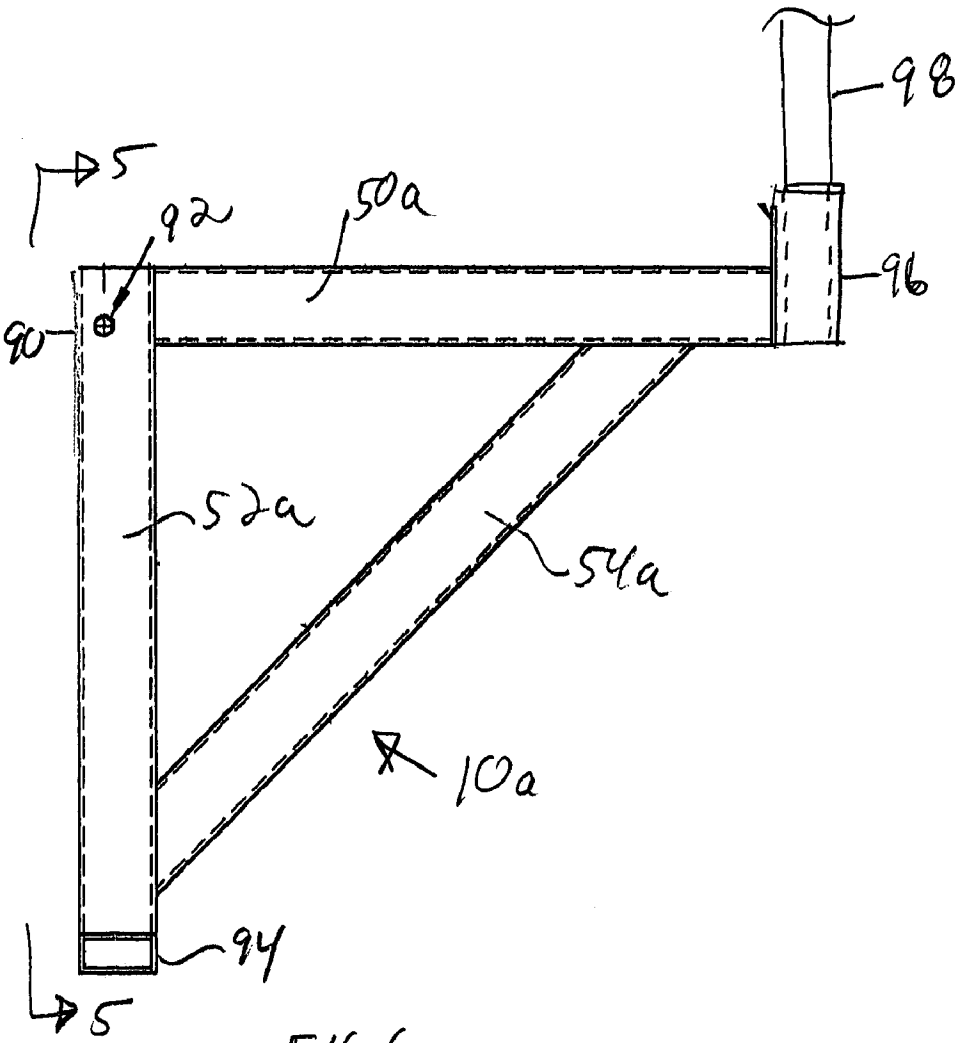
FIG. 6 is a side elevational view of the support bracket of FIG. 5.
Figure 5:
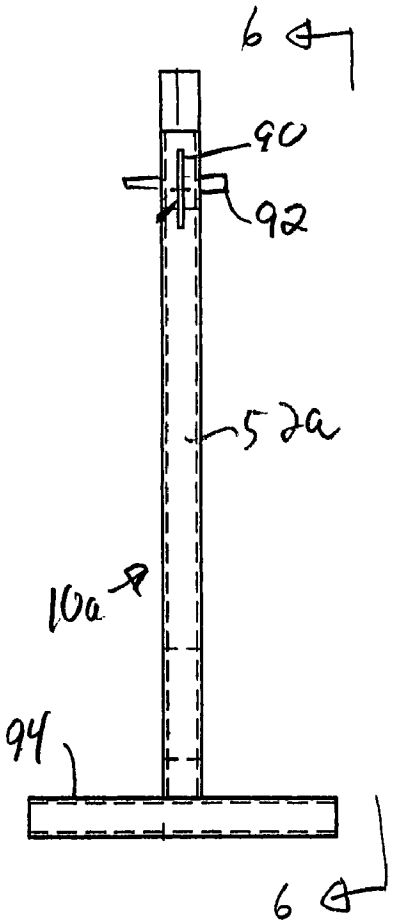
FIG. 5 is an end elevational view of a support bracket that is a second embodiment of the invention.

FIGS. 5 and 6 illustrate a support bracket 10*a* that is a second exemplary embodiment of the invention. The support bracket 10*a* is made from rectangular tubes, rather than from angle pieces.

The vertical piece 52*a* of the support bracket 10*a* has a vertically extending slot 90 that receives the tab 40 when the support bracket 10*a* is placed on the wall. A pin or clevis of some type as shown at 92 is inserted laterally through adjacent openings in the vertical piece 52*a* and through the opening 42 in the tab 40, to fasten the vertical piece to the tab of the wall bracket. The horizontal piece 50*a* and thus the support bracket 10*a* as a whole are suspended or hung from the tab 40.

The support bracket 10*a* has an optional stabilizer bar 94 at the lower end of the vertical piece 52*a*. The stabilizer bar 94 may be, as one example, a piece of tube or angle iron that is welded on the lower end of the vertical piece 52*a*. The stabilizer bar 94 can help to prevent the support bracket 10*a* from sliding laterally along the wall or from oscillating, and can help to keep the support bracket at a ninety degree angle to the wall. A stabilizer bar is optional with other embodiments of the invention.

Figure 7:
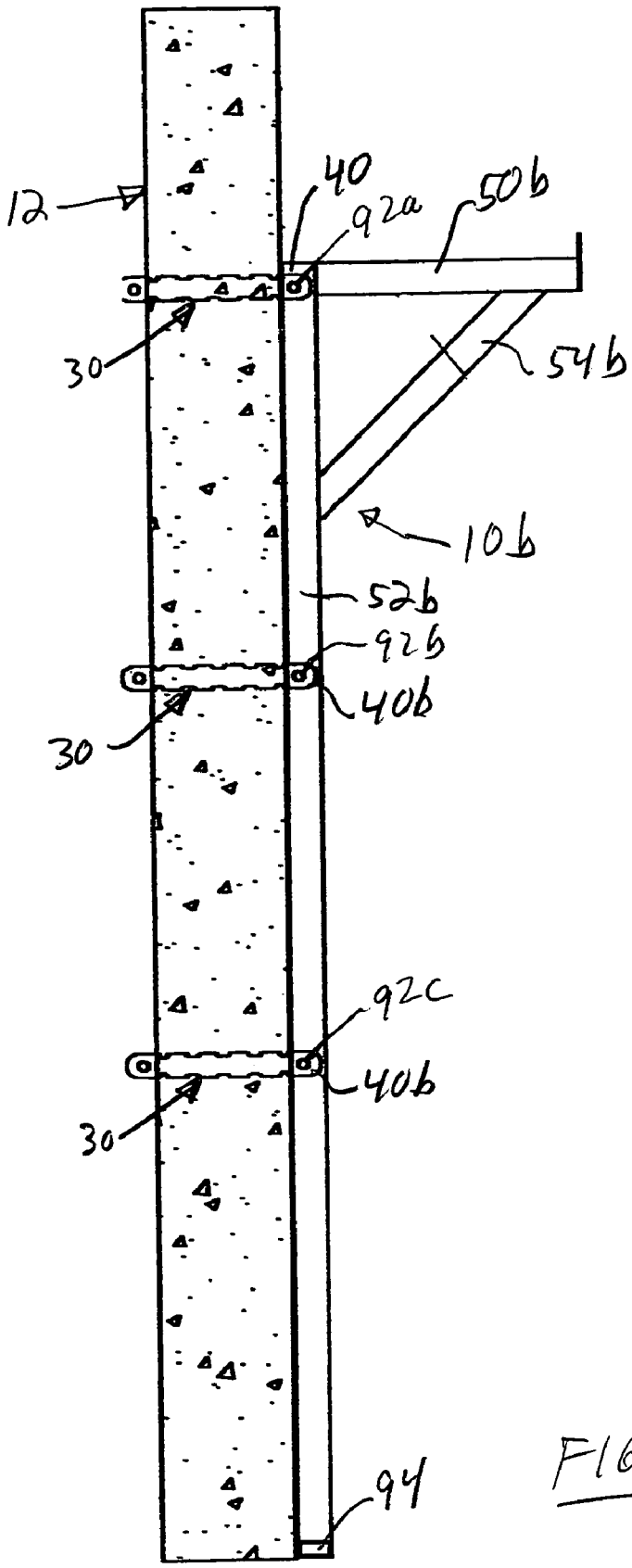
FIG. 7 is a side elevation of a support bracket that is a third embodiment of the invention, shown in association with a poured wall.

FIG. 7 illustrates a support bracket 10*b* that is a third embodiment of the invention. The support bracket 10*b* includes a vertical piece 52*b* that extends for a greater extent of the height of the wall 12 below the horizontal piece 50*b*. The vertical piece 52*b* secures to one or more tabs 40*b* that are below the tab 40. This can help to provide additional support.

In a concrete construction in which two walls meet at a corner, the corner is not supported—that is, the closest tab is four feet from the corner. In this case, the support bracket at that tab may be used to support a platform that extends into the corner. Still other alternatives are possible. For example, two support brackets may be permanently joined to each other with a platform between them, forming a generally U-shaped device that can be hung from a pair of adjacent tabs. Also, railing supports (for example a collar as shown schematically at 96) may be fixed to the outer ends of the horizontal pieces, adjacent, the stops, to support railings or uprights and rope as shown schematically at 98. As another alternative, tabs may be exposed on an interior wall, to be used for supporting shelving, etc.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A method of supporting a platform on a poured wall, comprising the steps of:

embedding a plurality of wall brackets in the poured wall during pouring of the wall, the wall bracket helping to support one or more forms used in forming the poured wall;

leaving in place a projecting portion of at least two of the wall brackets after the wall is poured and the forms are removed, wherein each projecting portion comprises a transverse opening;

providing at least two jacks each having a platform support operatively coupled to a fastener, wherein the platform support comprises a horizontal member and the fastener comprises a hook extending vertically upward from the horizontal member and curving downward to form the hook;

fastening each jack with the fastener to at least one of the wall brackets left in place to hang each jack from at least one of the wall brackets left in place, wherein each jack and fastener hang entirely beneath a top of the projecting portion of the wall bracket, and wherein the orientation of the hook of each fastener relative to the horizontal member of each platform support permits the hook to fasten to the transverse opening in the projecting portion extending from the wall to fasten the jack to the wall; and placing a platform on the platform supports of the at least two jacks hanging from the wall brackets left in place.

2. The method of supporting a platform on a poured wall according to claim 1 wherein the step of leaving in place comprises the step of leaving in place a projecting portion of enough wall brackets sufficient to support enough jacks hanging from wall brackets left in place to support a platform running substantially the entire length of the wall.

3. The method of supporting a platform on a poured wall according to claim 1 wherein the step of fastening each jack to at least one of the wall brackets left in place comprises the step of inserting the curved portion of the hook through the transverse opening of the wall bracket in a manner that each jack and hook hang entirely beneath a top of the projecting portion of the wall bracket.

4. A method of supporting a platform on a poured wall, comprising:

permitting at least two form securing tabs to remain embedded in and extending from the poured wall after fabrication of the wall and after removal of forms used during fabrication of the poured wall;

coupling a jack having a platform support to each of the at least two tabs extending from the wall, wherein the jack is coupled to the tab with a fastener and the jack and the fastener hang entirely beneath a top of the tab, and wherein the fastener comprises a hook extending vertically upward from the top of the platform support and curving downward to form the hook, the orientation of the hook relative to the platform support permitting the hook to fasten to a transverse opening in the tab; and positioning the platform on the platform supports such that a surface of the platform is supported in a substantially horizontal orientation.

5. The method of supporting a platform on a poured wall according to claim 4 wherein the step of coupling a jack to each of the at least two tabs comprises hanging a jack from each of the at least two tabs extending from the wall.

6. The method of supporting a platform on a poured wall according to claim 5 further comprising a stabilizing member operatively coupled to the platform support to engage the wall so that the platform support extends outward substantially perpendicular to the wall and the platform support is prevented from oscillating; and wherein the stabilizing member comprises an elongate stabilizer bar that is positioned at a lower end of the vertical member and forms a "T" with the vertical member and positioned to engage the wall to prevent the platform support from oscillating.

7. The method of supporting a platform on a poured wall according to claim 4 wherein the hook is positioned and configured to permit the jack to hang freely from the transverse opening in the tab remaining after removal of forms used during fabrication of the poured wall and further wherein the step of coupling a jack to each of the at least two tabs comprises hanging a jack from each of the at least two tabs extending from the wall.

8. The method of supporting a platform on a poured wall according to claim 7 further comprising a stabilizing member operatively coupled to the platform support to engage the wall so that the platform support extends outward substantially perpendicular to the wall and the platform support is prevented from oscillating; and wherein the stabilizing member comprises an elongate stabilizer bar that is positioned at a lower end of the vertical member and forms a "T" with the vertical member and positioned to engage the wall to prevent the platform support from oscillating.

9. The method of supporting a platform on a poured wall according to claim 4 further comprising a stabilizing member operatively coupled to the platform support to engage the wall so that the platform support extends outward substantially perpendicular to the wall and the platform support is prevented from oscillating; and wherein the stabilizing member comprises an elongate stabilizer bar that is positioned at a lower end of the vertical member and forms a "T" with the vertical member and positioned to engage the wall to prevent the platform support from oscillating.

10. A method of supporting a platform on a poured wall, comprising:

permitting at least two form securing tabs to remain embedded in and extending from the poured wall after fabrication of the wall and after removal of forms used during fabrication of the poured wall;

providing at least two jacks including;

(a) a horizontal member configured to engage a portion of the platform so that, when the platform is supported by the jack and at least one other jack, a surface of the platform is supported in a substantially horizontal orientation;

(b) at least one fastener operatively coupled to the horizontal member to fasten the horizontal member to at least one tab extending from the wall, the tab remaining after fabrication of the wall and the tab further remaining after removal of forms used during fabrication of the poured wall, wherein the at least one fastener comprises a hook extending vertically upward from the top of the platform support and curving downward to form the hook, the orientation of the hook relative to the horizontal member permitting the hook to fasten to a transverse opening in the tab;

(c) a stabilizing member operatively coupled to the horizontal member via a vertical member to engage the wall so that the horizontal member extends outward substantially perpendicular to the wall and the horizontal member is prevented from oscillating;

(d) a brace operatively coupled to the horizontal member and operatively coupled to the vertical member to help support the weight of the platform; and (e) a stop operatively coupled to the distal end of the horizontal member to stop the platform from sliding off the distal end of the horizontal member;

coupling one of the jacks with the fastener to each of the at least two tabs extending from the wall, wherein the jack and the fastener hang entirely beneath a top of the tab; and positioning the platform on the jacks such that a surface of the platform is supported in a substantially horizontal orientation.

11. The method of supporting a platform on a poured wall according to claim 10 wherein:

the stabilizing member comprises a stabilizer bar that is positioned at a lower portion of the vertical member;

the hook is positioned and configured to permit the jack and the hook to hang freely from the transverse opening in the tab entirely beneath the top of the tab; and the hook and stabilizing member cooperate to permit the jack to freely hang from the tab and contact the poured wall only at the stabilizing member while the horizontal member supports the portion of the platform.

12. The method of supporting a platform on a poured wall according to claim 11 wherein the stabilizing member comprises an elongate stabilizer bar that is positioned at a lower end of the vertical member and forms a "T" with the vertical member.

13. The method of supporting a platform on a poured wall according to claim 10 wherein the stabilizing member comprises an elongate stabilizer bar that is positioned at a lower end of the vertical member and forms a "T" with the vertical member.

14. The method of supporting a platform on a poured wall according to claim 10 wherein the stabilizing member comprises an elongate stabilizer bar that is positioned at a lower end of the vertical member and forms a "T" with the vertical member, and further wherein the stabilizer bar is about half as long as the vertical member to prevent oscillation of the jack.

15. The method of supporting a platform on a poured wall according to claim 11 wherein the stabilizing member comprises an elongate stabilizer bar that is positioned at a lower end of the vertical member and forms a "T" with the vertical member, and further wherein the stabilizer bar is about half as long as the vertical member to prevent oscillation of the jack.

16. A method of supporting a platform on a poured wall, comprising the steps of:

embedding a plurality of wall brackets in the poured wall during pouring of the wall, the wall bracket helping to support one or more forms used in forming the poured wall;

leaving in place a portion of at least two of the wall brackets that extends outward from the wall after the wall is poured and the forms are removed, wherein the extended portion of the wall bracket comprises a planar vertical portion having a transverse opening;

providing at least two jacks each having a vertical member and a horizontal member operatively coupled to a hook extending vertically upward from the horizontal member and curving downward to form the hook, wherein the hook is substantially perpendicular to a longitudinal axis of a horizontal member when the jack is in a configuration to be fastened to the wall bracket, and wherein the hook is coupled to a portion of the horizontal member between the vertical member and the wall such that the hook is spaced from the wall when the jack is in a configuration to be fastened to the wall bracket;

fastening each jack with the hook to the transverse opening of at least one of the wall brackets left in place to hang each jack from at least one of the wall brackets left in place, wherein each jack and hook hang entirely beneath a top of the extended portion of the wall bracket, and wherein the orientation of the hook relative to the horizontal member permits the hook to fasten to the transverse opening to fasten the jack to the wall; and placing a platform on the horizontal member of the at least two jacks hanging from the wall brackets left in place.

* * * * *